US006655476B2

(12) United States Patent
Groce, Jr. et al.

(10) Patent No.: US 6,655,476 B2
(45) Date of Patent: Dec. 2, 2003

(54) EARTH BORING BIT

(75) Inventors: Willie H. Groce, Jr., Yadkinville, NC (US); Brent L. Groce, Yadkinville, NC (US); Brian A. Groce, Yadkinville, NC (US)

(73) Assignee: Timothy R. Wall, Harmony, NC (US); part interest ( * ) Notice: Subject to any disclaimer, the term of this patent is extended or adjusted under 35 U.S.C. 154(b) by 0 days.

(21) Appl. No.: 10/283,659

(22) Filed: Oct. 30, 2002

(65) Prior Publication Data

US 2003/0070845 A1 Apr. 17, 2003

Related U.S. Application Data

(63) Continuation of application No. 09/791,235, filed on Feb. 23, 2001, now Pat. No. 6,533,048.

(51) Int. Cl.[7] ..... E21B 11/00
(52) U.S. Cl. ..... 175/316; 175/385; 175/391
(58) Field of Search ..... 175/385, 327, 175/391, 316, 335, 334, 388

(56) References Cited

U.S. PATENT DOCUMENTS 5,921,632 A * 7/1999 LeBegue
6,533,048 B2 * 3/2003 Groce, Jr. et al.

* cited by examiner

*Primary Examiner*—Roger Schoeppel
(74) *Attorney, Agent, or Firm*—Adams Evans P.A.

(57) ABSTRACT

An earth boring bit for boring a hole having a predetermined depth into the earth. The earth boring bit includes a cylindrical drum for being mounted for rotation on the end of a boom of a mobile machine and connected to and rotated by a power supply mounted on the boom. The drum includes an exterior for defining the diameter of the hole being bored and an interior adapted for receiving upturned earth therein as the hole is being bored. A plate is carried by the drum adjacent a lower end thereof for movement between a closed position for cooperating with the interior of the drum for retaining the upturned earth therein and an open position for dispensing the upturned earth out of the interior of the drum at a predetermined location away from the hole being bored. A cutting member is carried on the plate for cutting the earth in a progressive slice and directing the earth into the drum, thereby boring the hole into the earth.

12 Claims, 8 Drawing Sheets

EARTH BORING BIT

This is a continuation of application Ser. No. 09/791,235, filed Feb. 23, 2001, now U.S. Pat. No. 6,533,048.

TECHNICAL FIELD AND BACKGROUND OF THE INVENTION

This invention relates to an earth boring bit for boring very precise circular holes in the earth. Such holes include, but are not limited to, holes for foundation piers, footings and the like. Prior art auger-type machines are typically used to drill holes in the earth, and present a number of disadvantages. Specifically, the auger transports the earth upwardly and spills it on the ground around the hole. In many instances, the earth around the hole may fall back into the hole when the auger is removed, or may fall into nearby footings or foundation piers. In addition, boring a hole to a precise depth with an auger is difficult, since the auger provides no visual cues as to the distance of the tip of the auger below the earth. The flights of the auger must be relatively far apart to accommodate the earth being removed from the hole. This reduces the precision with which the hole is bored, and increases the amount of earth which falls from the auger when the auger is removed from the hole. Finally, even if the earth removed from the hole by the auger does not fall back into the hole, the earth is piled around the hole and must be removed by a completely separate operation, generally by hand by a laborer who uses a shovel.

The invention of the present application addresses the problems presented by prior art augers by providing a unique, rotating earth boring bit. The earth boring bit includes a cylindrical drum having an open lower end to which a plate is attached. Unique cutting assemblies are positioned on the plate. The earth boring bit is operatively connected to a hydraulic motor on a mobile machine such as a skid steer backhoe. Powered by the hydraulic motor of the mobile machine, the earth boring bit rotates, thereby causing the cutting assemblies to bore a hole into the earth by slicing and upturning the earth, and directing the upturned earth into the drum. The upturned earth is maintained within the drum until the boring process is completed, and is then removed from the drum after the earth boring bit has been moved to a location away from the freshly-bored hole. The unique structure of the present invention thus overcomes the disadvantages of prior art augers by providing an earth boring bit which is capable of boring a hole which has sidewalls that are perpendicular to the bottom of the hole, and which is free of upturned earth. The holes bored by the earth boring bit of the present invention are so precise that multiple holes may be bored in close proximity to one another without jeopardizing the structure of a single hole.

SUMMARY OF THE INVENTION

Therefore, it is an object of the invention to provide an earth boring bit which bores a hole of a precise depth and in a precise location.

It is another object of the invention to provide an earth boring bit that does not spill the earth from the bored hole onto the ground around and near the hole as the hole is being bored.

It is yet another object of the invention to provide an earth boring bit which includes means for transporting the earth removed from the bored hole to a predetermined location away from the hole for disposal.

It is another object of the invention to provide an earth boring bit which forms a clean, uniformly-sized hole having a relatively flat bottom and relatively perpendicular sides.

It is another object of the invention to provide an earth boring bit which can be operated from a tractor, backhoe, or other mobile machines.

These and other embodiments of the invention are achieved in the preferred embodiments disclosed below by providing an earth boring bit for boring a hole having a predetermined depth into the earth. The earth boring bit includes a cylindrical drum for being mounted for rotation on the end of a boom of a mobile machine and connected to and rotated by a power supply mounted on the boom. The drum includes an exterior for defining the diameter of the hole being bored and an interior adapted for receiving upturned earth therein as the hole is being bored. A plate is carried by the drum adjacent a lower end thereof for movement between a closed position for cooperating with the interior of the drum for retaining the upturned earth therein and an open position for dispensing the upturned earth out of the interior of the drum at a predetermined location away from the hole being bored. A cutting member is carried on the plate for cutting the earth in a thin, progressive slice and directing the earth into the drum, thereby boring the hole into the earth.

According to one preferred embodiment of the invention, the cutting member includes an opening extending through the plate and defined by adjacent teeth projecting outwardly away from the plate for cutting the earth into the progressive slice as the boring assembly rotates.

According to another preferred embodiment of the invention, the earth boring bit includes a pilot bit centrally positioned on and extending outwardly away from the plate for making a pilot hole in the earth for centering the earth boring bit within the hole as the earth boring bit rotates.

According to yet another preferred embodiment of the invention, the earth boring bit includes a spring-loaded handle engaging the plate for moving the plate between said open and closed positions.

According to yet another preferred embodiment of the invention, the handle includes an elongate rod having first and second ends. The rod is positioned within and extends through the interior of the drum. A latch is connected to the second end and cooperates with a complementary keyhole defined in and extending through the plate. The latch has a longitudinal axis positioned perpendicular to the longitudinal axis of the keyhole for maintaining the plate in its closed position. The latch is positioned parallel to the longitudinal axis of the keyhole for moving the plate into the open position. A handle is connected to the first end of the rod and cooperates therewith for selectively moving the latch between the perpendicular and parallel positions, thereby moving the plate between the closed and open positions, respectively.

According to yet another preferred embodiment of the invention, the earth boring bit includes two cutting members positioned in radial opposition to one another. The teeth on each of the cutting members collectively define a cutting edge extending perpendicularly from the pilot bit, thereby creating a cutting edge having an effective diameter equal to the diameter of the drum.

According to yet another preferred embodiment of the invention, the earth boring bit includes two opposing interior cutting members and two opposing exterior cutting members.

According to yet another preferred embodiment of the invention, each of the interior cutting members is positioned adjacent to the pilot bit, and each of the exterior cutting members is positioned adjacent to an outer edge of the plate.

According to yet another preferred embodiment of the invention, the teeth on each of the exterior cutting members form a cutting edge extending beyond said outer edge of the plate and having an effective diameter extending beyond the diameter of the plate for reducing friction on the exterior of the drum as the earth boring bit rotates.

According to yet another preferred embodiment of the invention, the teeth on each of the interior and exterior cutting members collectively define a cutting edge extending perpendicularly from the pilot bit for cutting a progressive slice of earth having a diameter which extends across the diameter of the plate.

According to yet another preferred embodiment of the invention, the plate and drum are pivotally connected together along common joint edges by a hinge element for permitting the plate to move between the open and closed positions.

According to yet another preferred embodiment of the invention, the earth boring bit includes a drive shaft operatively connected to the power supply mounted on the boom, wherein the drum and plate are coaxially mounted on said drive shaft for rotation therewith.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
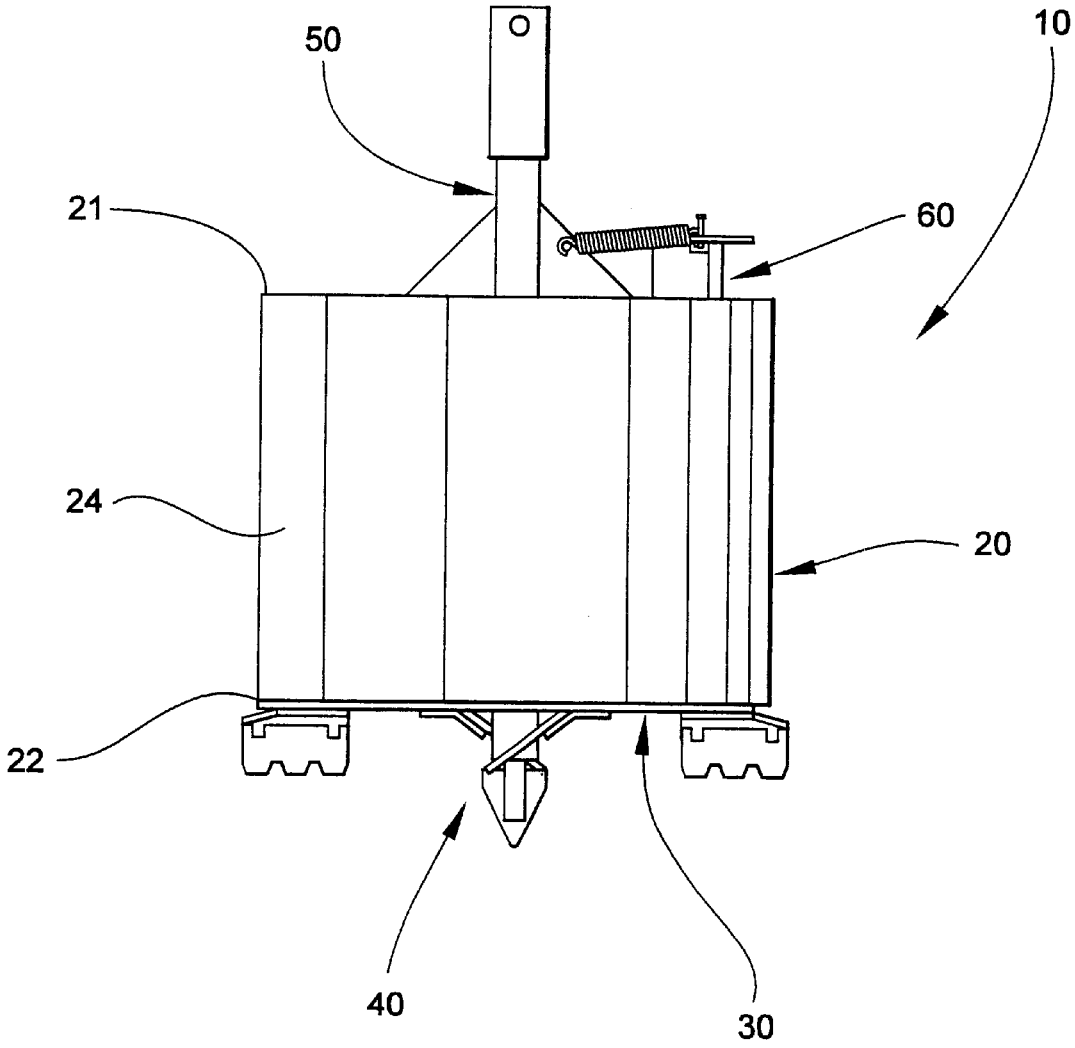
FIG. 1 is a side elevation of an earth boring bit according to the present invention.
Figure 2:
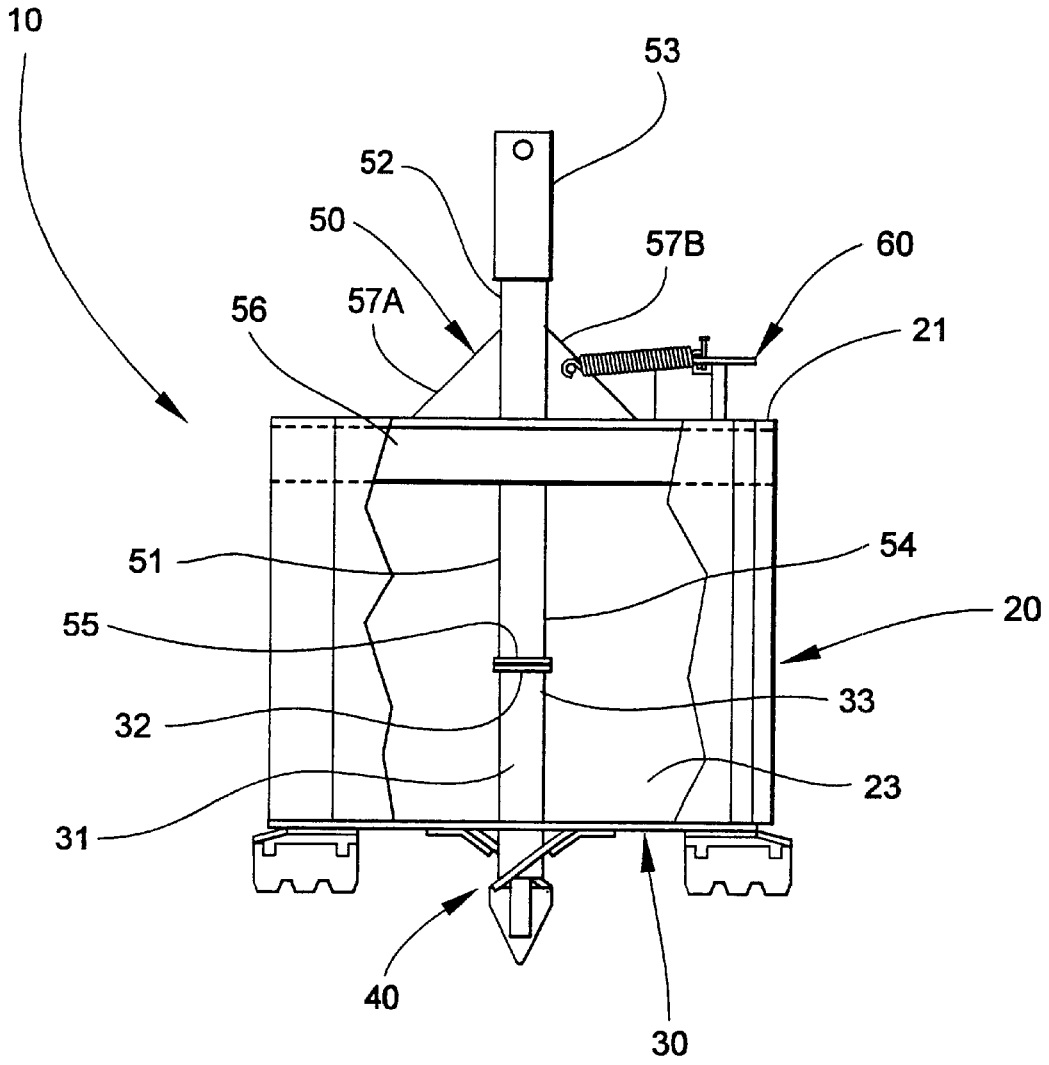
FIG. 2 is a cut-away side elevation of the earth boring bit shown in FIG. 1 showing the drive mechanism of the machine.

Referring now specifically to the drawings, an earth boring bit according to the present invention is illustrated in FIG. 1 and shown generally at reference numeral 10. The earth boring bit 10 includes a cylindrical drum 20, which has upper and lower open ends 21 and 22, respectively, and interior and exterior sidewalls 23 and 24 (interior sidewall 23 is shown in FIG. 2). While the drum 20 may have any diameter, the drum 20 preferably has a diameter of between 12 inches and 36 inches. A bottom plate 30 upon which a cutting assembly 40 is carried is attached to the interior of the drum 20 adjacent lower open end 22. The plate 30 is shown in FIG. 1 in a closed position. As discussed more fully below with reference to FIGS. 3 and 4, the cutting assembly 40 is used to cut progressive slices of earth as the hole is being bored. The upturned earth is retained within the drum 20 by the plate 30 until the upturned earth is removed from the drum 20 at a location away from the hole. As is shown in FIG. 1, the earth boring bit 10 is rotated by a drive mechanism 50, which is concentrically positioned within the drum 20, and is operatively connected to the plate 30. A handle assembly 60 likewise extends through the drum 20 and engages the plate 30 for moving the plate 30 between the closed position and an open position. See FIG. 3. As discussed in detail below with reference to FIGS. 6–8, the earth boring bit 10 is preferably operatively connected to the boom of a moving machine which is powered by a hydraulic motor.

Referring now to FIG. 2, the drive mechanism 50 is shown. The drive mechanism 50 includes a drive shaft 51 having a first end 52 affixed to a drive shaft receiver 53, and a second end 54 to which a cap plate 55 is attached. The drive shaft 51 is mounted on a cross brace 56 which is in turn welded to the interior sidewalls 23 on the upper end 21 of the drum 20. Mounting the drive shaft 51 in this manner permits the drive assembly 50 to rotate the drum 20 in unison with the rotation of the drive shaft 51. A pair of support flanges 57A and 57B are attached to the drive shaft 51 and cross brace 56, and stabilize the drive shaft 51 against the cross brace 56. While the upper end 21 of the drum 20 is open for permitting the interior of the drum 20 to be easily viewed, the drum 20 may alternatively include a top cover (not shown) which covers approximately three-fourths of the upper opening 21, thereby leaving approximately one-fourth of the upper opening 21 uncovered for permitting the interior of the drum 20 to be viewed by an individual operating the earth boring bit 10.

As is shown in FIG. 2, the plate 30 includes a center drive plate shaft 31 which is centrally positioned on the plate 30. A cap plate 32 is attached to an upper end 33 of the shaft 31 and engages the cap plate 55 on the second end 54 of the drive shaft 51 when the plate 30 is in the closed position. The shaft 31 is preferably formed from steel, and supports and stabilizes the plate 30.

Figure 3:
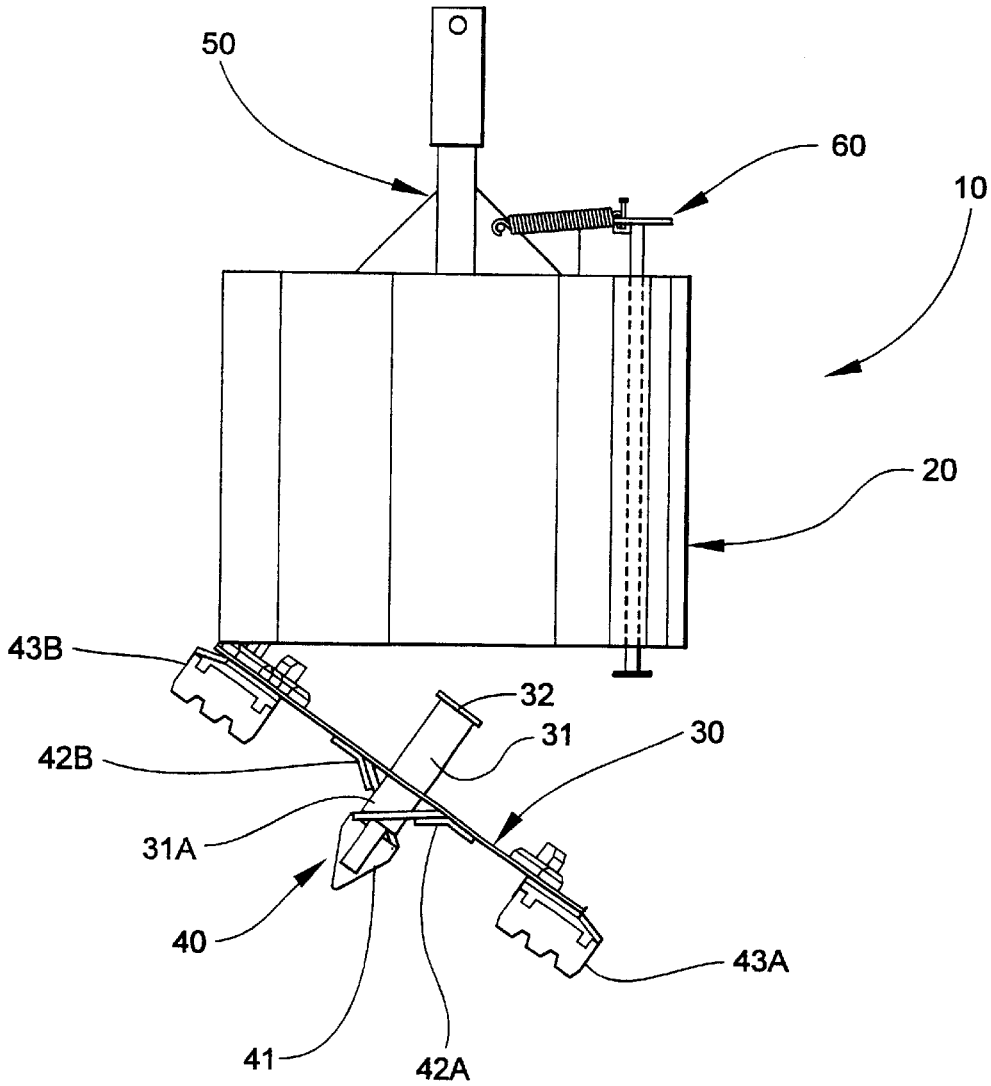
FIG. 3 is a side elevation of the earth boring bit showing the bottom plate of the machine in an open position.

Referring now to FIG. 3, the plate 30 is shown in the open position. The cutting assembly 40 is carried by the plate 30 and includes a pilot bit 41, and inner and outer cutting members 42A, 42B, and 43A, 43B, respectively. The pilot bit 41 is affixed to an extension 31A of the drive plate shaft 31 for making a pilot hole in the earth to center and guide the earth boring bit 10 as the boring process begins.

Figure 4:
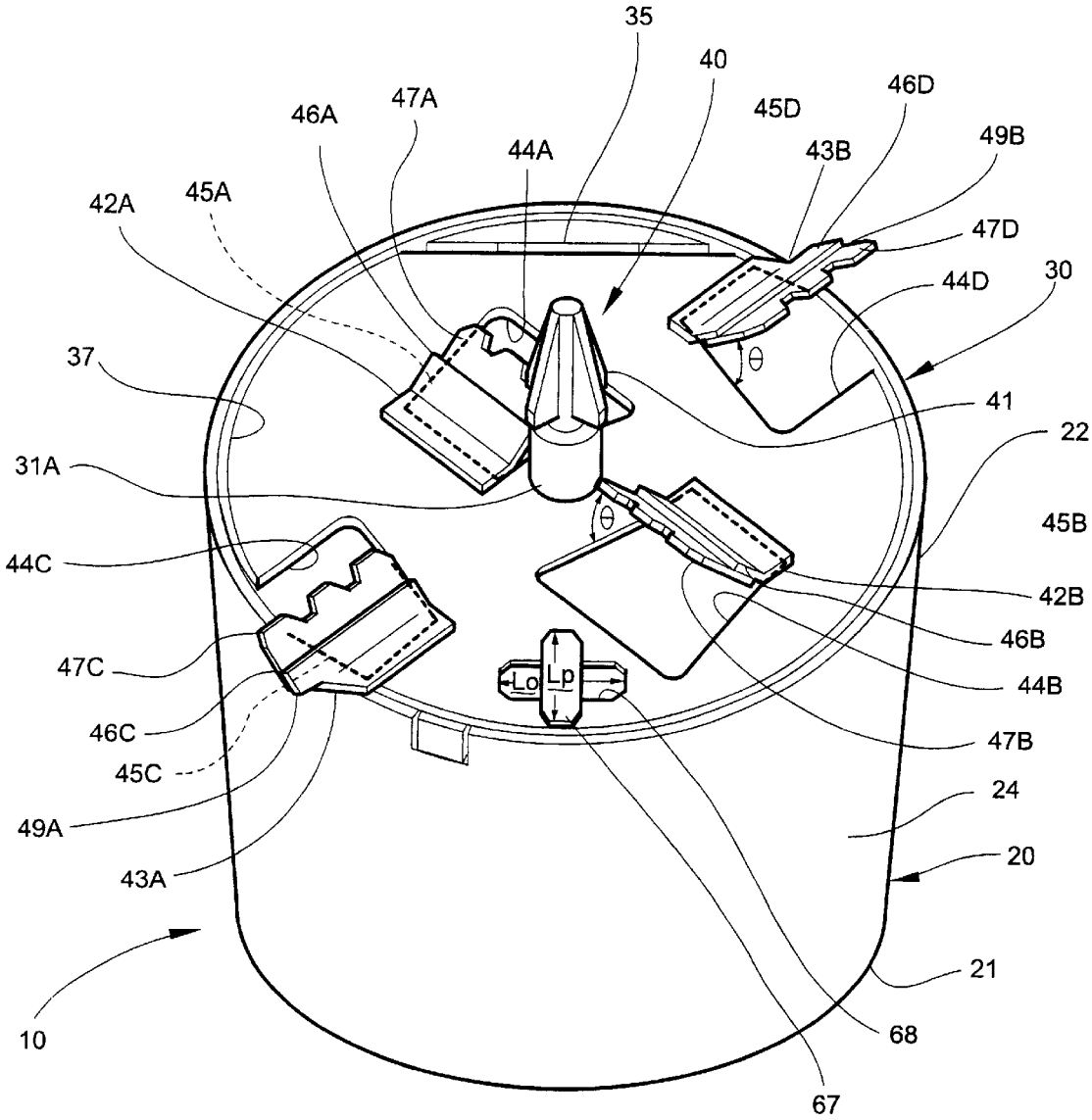
FIG. 4 is a perspective view of the earth boring bit showing the bottom of the earth boring bit.

Referring now to FIG. 4, each inner and outer cutting member 42A, 42B, 43A, and 43B, includes a respective opening 44A, 44B, 44C and 44D which is defined by and extends through the plate 30. The openings 44A, 44B, 44C and 44D include respective edges 45A, 45B, 45C and 45D to which respective downwardly-projecting cutting plates 46A, 46B, 46C and 46D are attached. Each cutting plate 46A, 46B, 46C and 46D is preferably formed from steel, and includes a row of cutting teeth 47A, 47B, 47C and 47D, respectively.

As discussed more fully in reference to FIGS. 6–8 below, the cutting teeth 47A, 47B, 47C and 47D cut into the earth in a progressive slice as the earth boring bit 10 rotates. Although any number of teeth may be used, each row of cutting teeth 47A, 47B, 47C and 47D preferably includes three teeth. The teeth 47A, 47B, 47C and 47D cooperate with the respective cutting plates 46A, 46B, 46C and 46D to drive the upturned earth through the respective openings 44A, 44B, 44C and 44D into the interior of the drum 20 as the earth boring bit 10 rotates. The earth is then retained until the plate 30 is moved into the open position. As is shown in FIG. 4, the plate 30 is moved between the open and closed positions using a hinge 35, which preferably includes a rolled steel hinge pin which cooperates with a complementary hinge plate.

Each row of cutting teeth 47A, 47B, 47C and 47D is preferably attached to the corresponding cutting plate 46A, 46B, 46C or 46D at least a 35 degree angle "θ" from a bottom surface 36 of the plate 30. As shown in FIG. 4, the inner cutting members 42A and 42B are positioned adjacent the pilot bit 41 and opposite one another so that the respective rows of teeth 47A and 47B extend outwardly away from and are positioned perpendicular to the plate shaft extension 31A and bit 41. The outer cutting members 43A and 43B are positioned adjacent an outer edge 37 of the plate 30 and opposite one another so that the respective rows of teeth 47C and 47D likewise extend outwardly away from and are positioned perpendicular to the plate shaft extension 31A and bit 41. Furthermore, each outer cutting member 43A and 43B is positioned on the plate 30 so that outer end 49A and 49B of the respective cutting members 43A and 43B each extend beyond the outer edge 37 of the plate 30. Positioning the outer cutting members 43A and 43B on the plate 30 in this manner causes the outer cutting members 43A and 43B to cut slices of earth which form a hole having a diameter which is slightly larger than diameter of the exterior sidewalls 24 of the drum 20. This reduces friction on the exterior sidewalls 24 during operation, thus extending the life of the drum 20 and earth boring bit 10. When in use, the inner and outer cutting members 42A, 42B and 43A, 43B collectively cut circular slices of earth having a diameter slightly greater than the diameter of the plate 30.

Figure 5:
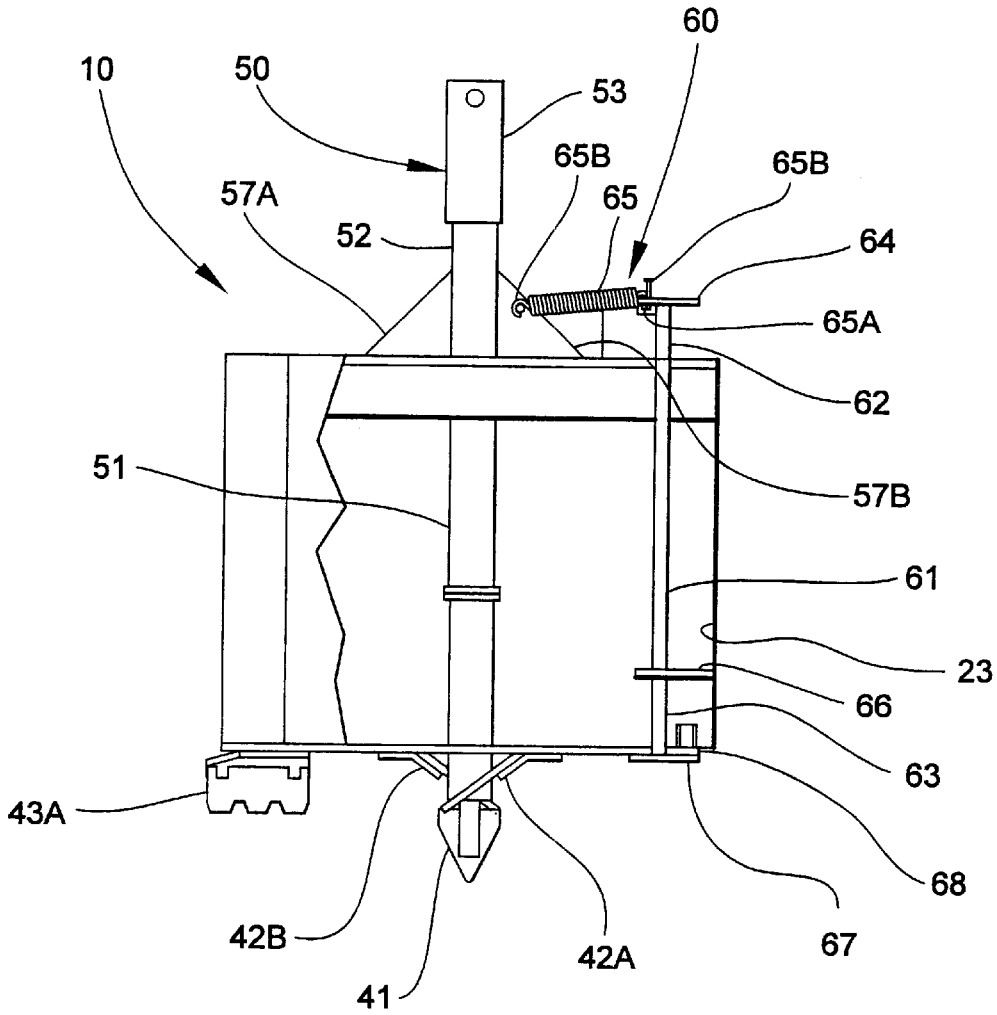
FIG. 5 is a cut-away side elevation of the earth boring bit showing the handle assembly of the machine.

Referring now to FIG. 5, the earth boring bit 10 is shown with the outer cutting member 43B removed to show the handle assembly 60. The handle assembly 60 includes an elongate rod 61 having first and second ends 62 and 63. The rod 61 preferably has a diameter of ¾ inch and is positioned within and extends through the interior of the drum 20 adjacent the interior sidewall 23. The rod 61 is received and held by a tube support 66 which is attache to the interior sidewall 23 of the drum 20. The tube support provides enhanced stability and support to the rod 61. A latch handle 64 is attached to the first end 62 of the rod 61, and is interconnected to the support flange 57B by a spring 65. Complementary zinc nuts and bolts 65A and 65B connect the spring 65 to the flange 57B and the handle 64. The spring 65 is preferably a compression spring, and cooperates with the latch handle 64 to move the handle assembly 60 between, and maintain the handle assembly 60 in, the open and closed positions.

The handle assembly 60 also includes a latch plate 67, which is attached to the second end 63 of the rod 61. The latch plate 66 is shown in FIGS. 4 and 5 maintaining the plate 30 in the closed position. As is shown in FIG. 4, the plate 30 includes an opening 68 which has a shape complementary to the shape of the latch plate 67. Referring again to FIG. 5, the second end 63 of the rod 61 and the latch plate 67 both extend through the opening 68. When the plate 30 is in the closed position, latch plate 67 is positioned so that its longitudinal axis "$L_P$" is generally perpendicular to the longitudinal axis "$L_O$" of the opening 68. To move the handle assembly 60 to the open position, the latch handle 64 is rotated 90 degrees against the force of the spring 65, which rotates the rod 61 around its longitudinal axis. This in turn causes the latch plate 67 to rotate until its longitudinal axis "$L_P$" is in alignment with the longitudinal axis "$L_O$" of the opening 68. This permits the plate 30 to move into the open position shown in FIG. 3 using the hinge 35.

Figure 6:
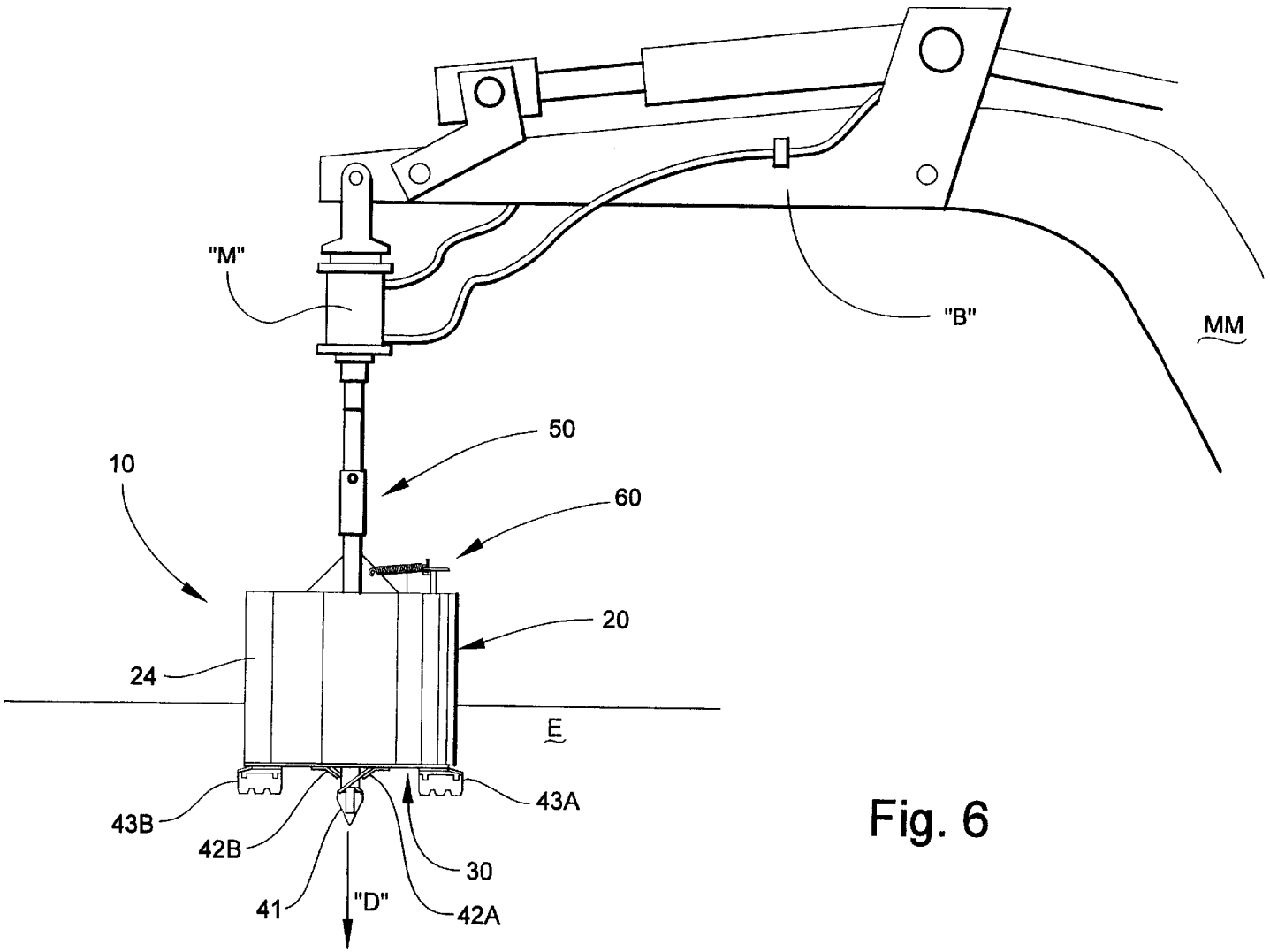
FIG. 6 is an environmental perspective view of the earth boring bit with the bottom plate in a closed position.
Figure 7:
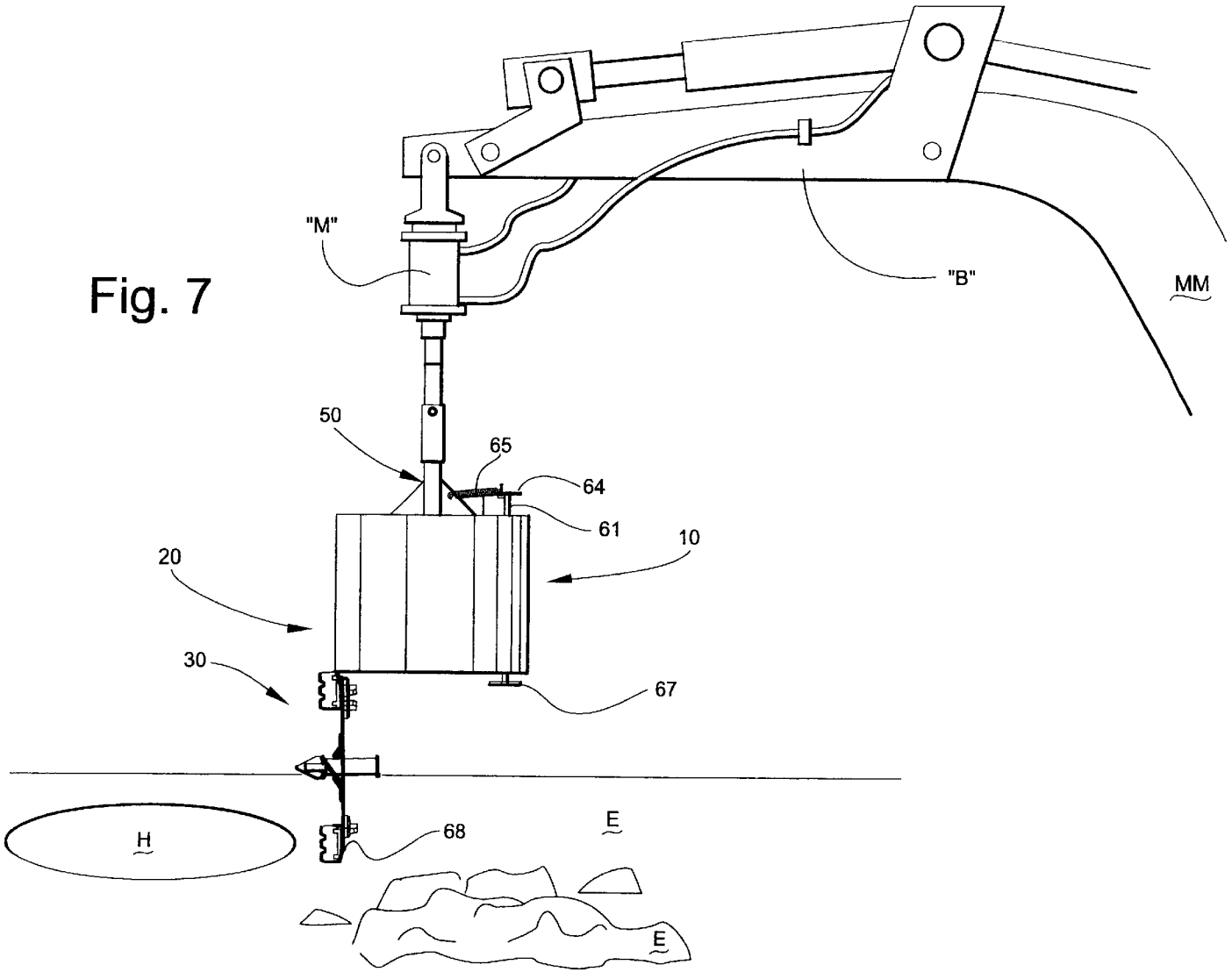
FIG. 7 an environmental perspective view of the earth boring bit showing upturned earth being removed from the machine after a hole has been bored.
Figure 8:
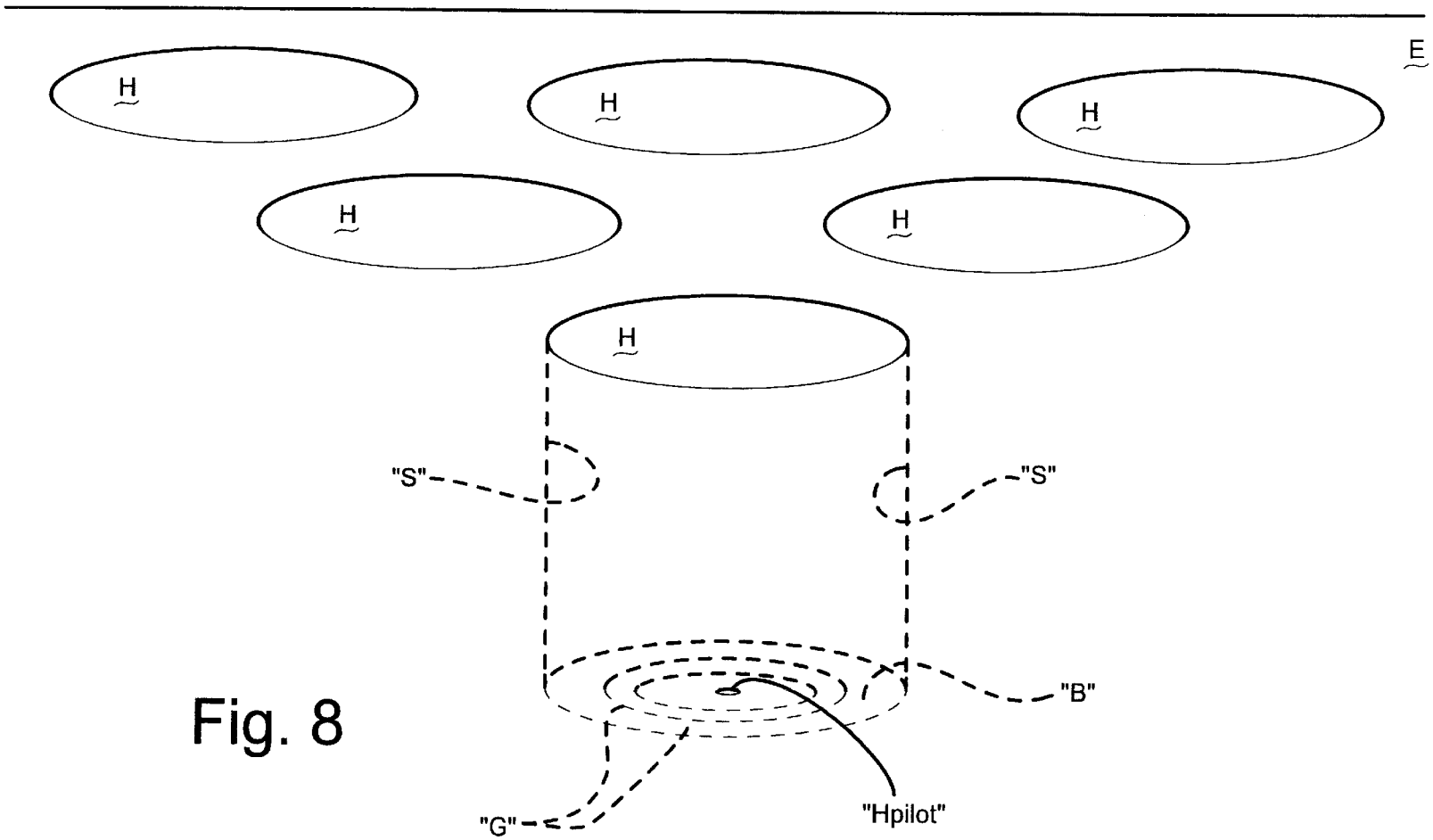
FIG. 8 is an environmental perspective view of a series of holes created by the earth boring bit of the present invention.

Referring now to FIGS. 6, 7 and 8, the earth boring bit 10 is shown being used to bore a hole into the earth. The earth boring bit 10 is shown in FIGS. 6, 7 and 8 connected to a hydraulic motor "M" which is connected to the boom "B" of a mobile machine "MM". To use the earth boring bit 10 to bore a hole, the earth boring bit 10 is centered over the site where the hole is to bored and is lowered into position in the direction "D" shown. The pilot bit 41 maintains the machine 10 in position while the hydraulic motor "M" is actuated, which in turn causes the drive assembly 50 to rotate the drum 20 and plate 30. The overall design of the earth boring bit and the angle of the teeth on the inner and outer cutting members 42A, 42B and 43A, 43B causes the earth boring bit 10 to begin cutting away a slice of the earth "E" as the earth boring bit 10 rotates. As the rows of teeth 47A, 47B, 47C and 47D on the cutting members 42A, 42B, 43A and 43B continue to cut into the earth "E", the upturned earth "E" is pushed into the interior of the drum 20. The depth of the hole being bored can accurately be determined by observing that portion of the drum 20 which is still above the ground. The drum 20 may alternatively include markings on the exterior sidewall 24 for further facilitating the accuracy of the cut (not shown). Furthermore, the earth boring bit 10 can be withdrawn from the hole during the boring process to check the depth of the hole. Cuts up to 12 inches can be made in a single operation, based upon soil type and density. As discussed above, the plate 30 cooperates with the drum 20 to prevent earth "E" from falling back into the hole as the earth boring bit 10 is removed therefrom.

Referring now to FIG. 7, when the drum 20 has been filled with earth, the earth boring bit 10 is lifted from the hole "H". The earth boring bit 10 is then moved to a preselected location away from the hole "H" so that the upturned earth "E" can be emptied out of the drum 20. The earth boring bit 10 is moved by swinging the boom "B" upon which the earth boring bit 10 is mounted away from the hole "H". If the earth boring bit 10 is attached to a tractor, skid steer backhoe, or other mobile machine having a stationary boom "B", the earth boring bit 10 must be moved away from the hole "H" by moving the entire mobile machine to the preselected location.

To remove the earth from the drum 20, the latch handle 64 is turned so that the longitudinal axis "$L_P$" of the latch plate 67 is alignment with the longitudinal axis "$L_O$" of the opening, which in turn causes the plate 30 to fall open. The plate 30 may be moved into the open position in a controlled manner by maintaining the plate 30 just slightly above ground level when the handle assembly 60 is unlatched so that the pilot bit 41 and the side edge 37 of the plate 30 touches the ground, and then slowing lifting the earth boring bit 10 to allow the plate 30 to swing open gradually. Once all of the earth has fallen out of the drum 20, the plate 30 can be returned to the closed position. This is be done by lowering the earth boring bit 10 until the bottom of the plate 30 is resting on the ground, so that it is necessary only to insure that the latch plate 67 is properly positioned in the opening 68 in the plate 30. The handle 64 is then manually turned, thereby rotating the rod 61 and latch plate 67 into the closed position. In an alternative embodiment of the invention, the spring 65 attached to the latch handle 64 automatically rotates the rod 61 and latch plate 67 into the closed position (Not shown).

Referring now to FIG. 8, each hole "H" formed by the earth boring bit 10 has smooth, even and uniform sides "S" which are perpendicular to the bottom "B" of the hole "H". The bottom "B" of the hole "H" is flat, and has a small pilot hole "$H_{pilot}$" in its center about which shallow concentric grooves "G" have been formed by the cutting teeth 42A, 42B, 43A and 43B (not shown). The hole formation process is so precise that the each of the holes "H" may be formed only several inches apart without causing any damage to the other already-formed holes.

The depth of holes bored with the earth boring bit 10 is limited only by the length of the drive shaft 31. Although the drive shaft 31 may be of any length, a preferred length is 56 inches. Therefore, a hole "H" having a depth of approximately 56 inches can be formed by boring the hole "H" in several stages and emptying the drum 20 as required.

An earth boring bit is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. An earth boring bit for boring a hole having a predetermined depth into the earth, comprising:

(a) a cylindrical drum for being mounted for rotation on the end of a boom of a mobile machine and connected to and rotated by a power supply mounted on the boom, said drum including an exterior for defining the diameter of the hole being bored and an interior adapted for receiving upturned earth therein as the hole is being bored;

(b) a plate carried by said drum adjacent a lower end thereof for movement between a closed position for cooperating with the interior of the drum for retaining the upturned earth therein and an open position for dispensing the upturned earth out of the interior of the drum at a predetermined location away from the hole being bored; and (c) a cutting member carried on said plate for cutting the earth in a progressive slice and directing the earth into the drum, thereby boring the hole into the earth.

2. An earth boring bit according to claim 1, wherein said cutting member comprises an opening extending through said plate and defined by adjacent teeth projecting outwardly away from the plate for cutting the earth into the progressive slice as said boring assembly rotates.

3. An earth boring bit according to claim 2, and including a pilot bit centrally positioned on and extending outwardly away from the plate for making a pilot hole in the earth for centering the earth boring bit within the hole as the earth boring bit rotates.

4. An earth boring bit according to claim 3, and including two cutting members positioned in radial opposition to one another, wherein said teeth on each of said cutting members collectively define a cutting edge extending perpendicularly from the pilot bit, thereby creating a cutting edge having an effective diameter equal to the diameter of the drum.

5. An earth boring bit according to claim 3, and including two opposing interior cutting members and two opposing exterior cutting members.

6. An earth boring bit according to claim 5, wherein each of said interior cutting members is positioned adjacent to the pilot bit, and each of said exterior cutting members is positioned adjacent to an outer edge of the plate.

7. An earth boring bit according to claim 6, wherein said teeth on each of the exterior cutting members extend beyond said outer edge of the plate, thereby creating a cutting edge having an effective diameter extending beyond the exterior diameter of the drum for reducing friction on the exterior of the drum as the earth boring bit rotates.

8. An earth boring bit according to claim 6, wherein the teeth on each of the interior and exterior cutting members collectively define a cutting edge extending perpendicularly from the pilot bit for cutting a thin, progressive slice of earth having a diameter which extends across the diameter of the plate.

9. An earth boring bit according to claim 1, and including a spring-loaded handle engaging the plate for moving the plate between said open and closed positions.

10. An earth boring bit according to claim 9, wherein said handle comprises:

(a) an elongate rod having first and second ends, said rod positioned within and extending through the interior of the drum;

(b) a latch connected to said second end and cooperating with a complementary keyhole defined in and extending through the plate, said latch having a longitudinal axis positioned perpendicular to the longitudinal axis of said keyhole for maintaining the plate in its closed position, and positioned parallel to the longitudinal axis of the keyhole for moving the plate into the open position; and (c) a handle connected to said first end of the rod and cooperating therewith for selectively moving the latch between the perpendicular and parallel positions, thereby moving the plate between the closed and open positions, respectively.

11. An earth boring bit according to claim 1, wherein said plate and drum are pivotally connected together along common joint edges by a hinge element for permitting the plate to move between the open and closed positions.

12. An earth boring bit according to claim 1, and including a drive shaft operatively connected to the power supply mounted on the boom, wherein the drum and plate are coaxially mounted on said drive shaft for rotation therewith.

* * * * *